US008151686B2

(12) United States Patent
Ravid et al.

(10) Patent No.: US 8,151,686 B2
(45) Date of Patent: Apr. 10, 2012

(54) ARMOR MODULE

(75) Inventors: Moshe Ravid, Hod Hasharon (IL); Amit Viesel, D.N. Marom Hagalil (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 213 days.

(21) Appl. No.: 12/651,046

(22) Filed: Dec. 31, 2009

(65) Prior Publication Data

US 2011/0030543 A1 Feb. 10, 2011

(30) Foreign Application Priority Data

Dec. 31, 2008 (IL) ..... 196310

(51) Int. Cl.
*F41H 5/04* (2006.01)
*B32B 5/12* (2006.01)

(52) U.S. Cl. ..... 89/36.02; 89/36.04

(58) Field of Classification Search ..... 89/36.02, 89/36.04, 36.11, 908, 914, 907; 428/114, 428/364

See application file for complete search history.

(56) References Cited

U.S. PATENT DOCUMENTS

| | | | | |
|---|---|---|---|---|
| 4,567,100 | A | 1/1986 | Pickett et al. | |
| 4,732,803 | A * | 3/1988 | Smith, Jr. | 428/212 |
| 4,836,084 | A * | 6/1989 | Vogelesang et al. | 89/36.02 |
| 5,035,952 | A | 7/1991 | Bruinink et al. | |
| 5,200,256 | A * | 4/1993 | Dunbar | 428/212 |
| 5,306,557 | A * | 4/1994 | Madison | 428/304.4 |
| 5,349,893 | A * | 9/1994 | Dunn | 89/36.05 |
| 5,376,426 | A | 12/1994 | Harpell et al. | |
| 5,796,028 | A | 8/1998 | Field et al. | |
| 6,571,677 | B1 | 6/2003 | Kaura | |
| 7,549,366 | B2 | 6/2009 | Park et al. | |
| 7,997,181 | B1 * | 8/2011 | Tunis et al. | 89/36.02 |
| 2004/0166755 | A1 | 8/2004 | Bergmans et al. | |
| 2007/0293107 | A1 * | 12/2007 | Follo et al. | 442/134 |
| 2009/0169855 | A1 | 7/2009 | Tunis | |
| 2011/0041675 | A1 * | 2/2011 | Ermalovich | 89/36.02 |

FOREIGN PATENT DOCUMENTS

| | | | |
|---|---|---|---|
| WO | 2005022071 | A1 | 3/2005 |
| WO | 2006005983 | A2 | 1/2006 |
| WO | 2008144892 | A1 | 12/2008 |
| WO | 2009017518 | A1 | 2/2009 |
| WO | 2009096956 | A1 | 8/2009 |

* cited by examiner

*Primary Examiner* — Troy Chambers
(74) *Attorney, Agent, or Firm* — The Nath Law Group; Susanne M. Hopkins; William L. Klima

(57) ABSTRACT

An armor module for protecting a surface against an explosively formed projectile (EFP) threat is provided. The armor module is configured for mounting on the surface and comprises at least one armor assembly having a hard layer disposed facing the threat and being configured to fragment the EFP, thus forming residuals of the original EFP threat; a unidirectional fiber layer disposed behind the hard layer; and a catcher layer behind the unidirectional fiber layer, the catcher layer being made of a material exhibiting a level of ballistic protection such that a layer of the material being of the same thickness as the unidirectional fiber layer absorbs at least 20% more energy than is the unidirectional fiber layer for the same threat.

15 Claims, 1 Drawing Sheet

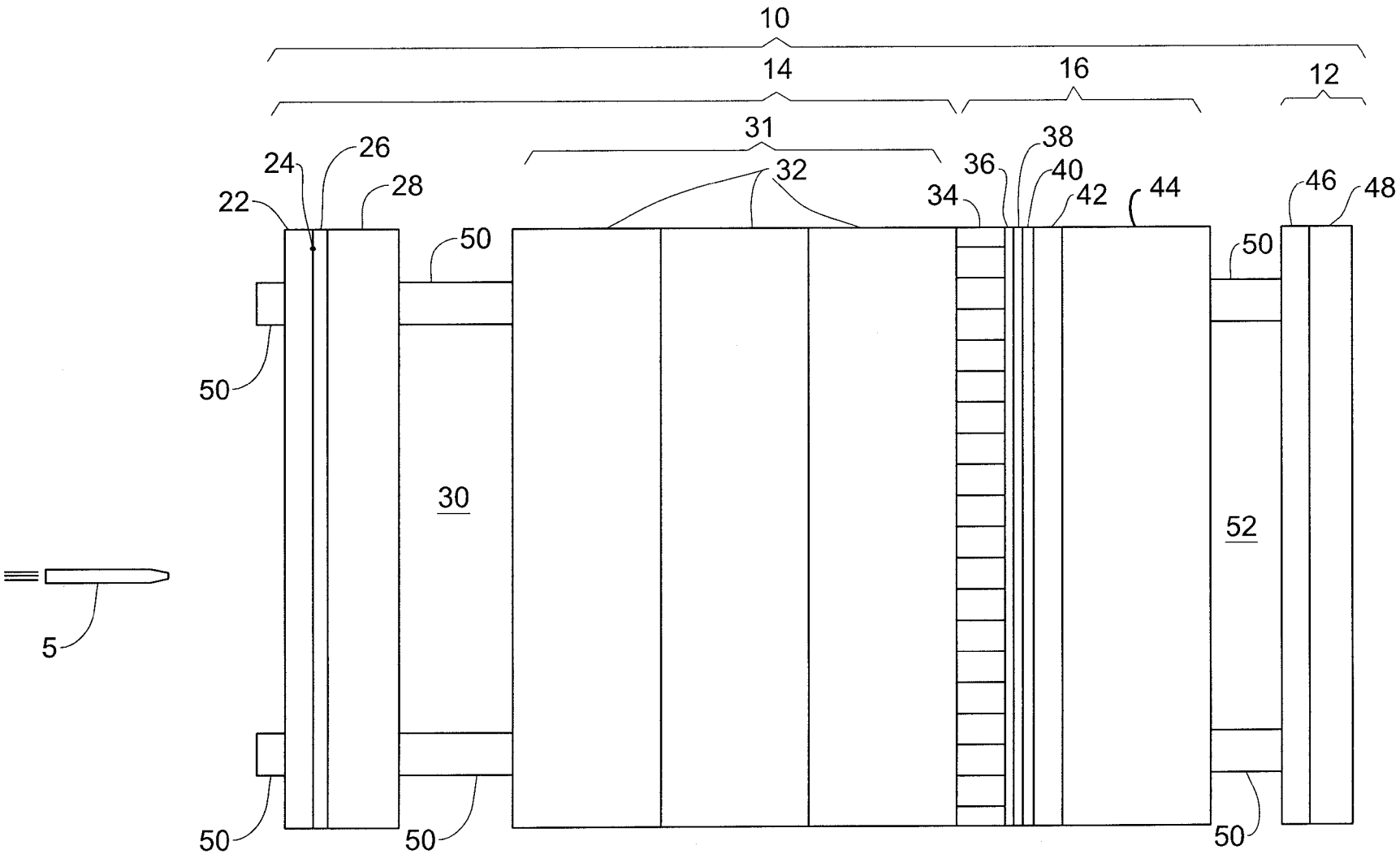
10
12
14
16
31
32
34
36
38
40
42
44
46
48
50
52
30
26
28
24
22
5

ARMOR MODULE

FIELD OF THE INVENTION

This invention relates to an armor module adapted to protect a body from an incoming projectile, in particular against explosively formed projectile charges (EFP).

BACKGROUND OF THE INVENTION

When designing ballistic armor for protecting, for example, a vehicle, consideration must be given to the type of projectile against which the armor must protect.

An important consideration which must be taken into account when designing ballistic armor is the weight per coverage area of the armor. Theoretically, armor can be constructed to protect against almost any threat or combination of threats. However, the resulting weight of the minor needed for such protection should be practical for the intended use. For example, when designing armor for vehicles such as trucks, armored infantry fighting vehicles, or armored personnel carriers, heavy armor will negatively impact the maneuverability and fuel efficiency of the vehicle, and will be more difficult to replace when necessary. Heavy armor can exceed the gross vehicle weight (GVW) set by the vehicle manufacturer and therefore cannot be used for such vehicle.

One type of threat is referred to as an explosively formed projectile (EFP). An EFP has a metal liner in the shape of a shallow dish with an explosive material behind it. When the explosive material is detonated the force of the blast presses the liner plastically into any of a number of configurations, depending on how the plate is formed and how the explosive is detonated. For example, the liner may be molded into a narrow rod, a "fist", a plate (dish), or segmented rod.

SUMMARY OF THE INVENTION

According to one aspect of the present invention, there is an armor module for protecting a surface against an explosively formed projectile (EFP) threat, the armor module being configured for mounting on the surface and comprising at least one armor assembly having:

- a hard layer disposed facing the threat and being configured to fragment the EFP, thus forming residuals of the original EFP threat;
- a unidirectional fiber layer disposed behind the hard layer; and
- a catcher layer behind the unidirectional fiber layer, the catcher layer being made of a material exhibiting a level of ballistic protection such that a layer of the material being of the same thickness as the unidirectional fiber layer absorbs at least 20%, and according to another example at least 30%, more energy than is the unidirectional fiber layer for the same threat (i.e., under the same ballistic conditions, including the same type of projectile at the same velocity).

It will be appreciated that hereafter in the specification and claims the terms "in front" and "behind" refer to directions with reference to the expected direction of the threat, with "in front" meaning closer to the expected direction of the threat, and "behind" meaning farther from the expected direction of the threat.

The specific weight of the catcher layer may be no more than 90%, and according to some examples no more than 85%, of that of the unidirectional fiber layer.

The fibers constituting the unidirectional fiber layer may constitute a portion of a laminate, the tensile strength of most of the fibers exceeding the force required to remove them from the laminate.

The unidirectional fiber layer may comprise aramid fibers.

The catcher layer may comprise a plurality of pressed fibers, which may be arranged unidirectionally, and which may be made from a material selected from the group comprising polypropylene and high density polyethylene. The catcher layer may comprise at least two times, and according to some example at least four times, as many fibers per unit thickness thereof than does the unidirectional fiber layer. In addition, the fibers of the catcher layer may be characterized by a specific tensile strength which is at least 10% greater than those of the unidirectional fiber layer.

The material of the catcher layer may be more sensitive to an elevated temperature of an impinging threat than is the material of the unidirectional fiber layer, i.e., the catcher layer may exhibit a reduced level of ballistic protection against a projectile having an elevated temperature associated with residuals of the EFP, the unidirectional fiber layer exhibiting a level of ballistic protection which remains essentially unchanged, or significantly less reduced as the catcher layer, at that temperature.

The hard layer may be provided with a backing layer, which may comprise an at least partially or fully woven aramid material, facing the catcher layer, each of the hard, backing, and catcher layers being characterized by a ballistic impedance such that the ballistic impedance of the backing layer is lower than that of the hard layer and higher than that of the catcher layer. It will be appreciated the ballistic impedance of a material is defined as the product between its specific density $\rho$ and the speed of sound through the material.

The hard layer may comprise a material selected from the group comprising high-hardness steel and ballistic ceramic.

The armor assembly may further comprise a stand-off between the unidirectional fiber and catcher layers, the stand-off being free of material of the module.

The armor module may further comprise one of the armor assemblies disposed in front of another of the armor assemblies.

BRIEF DESCRIPTION OF THE DRAWINGS

In order to understand the invention and to see how it may be carried out in practice, an embodiment will now be described, by way of a non-limiting example only, with reference to the accompanying drawings, in which:

FIG. 1 is a partial cross-sectional view of one example of an armor module according to the present invention mounted to the hull of a vehicle.

DETAILED DESCRIPTION OF EMBODIMENTS

As illustrated in FIG. 1, there is provided an armor module, which is indicated at 10, which is designed to defeat an explosively formed projectile (EFP) threat, which is indicated at 5 in its expected direction of travel toward the armor module. The module is configured for mounting on an armored vehicle having a hull 12 constituting a surface to be protected, which, in the present example, constitutes a base armor. The hull may be armored and thus exhibit a level of protection which allows it defeat KE threats i.e. fragment and penetrators, which are much less effective than EFP. It may, for example, comprise a layer of high-hardness steel disposed in front of a spall liner, which may comprise one or more of an aramid material, a high density polyethylene material, or any composite liner material. The hull 12 exhibits a level of protection, and the minor module is designed such that any residuals of the EFP exiting it are within the level of protection of the hull 12.

The armor module 10 comprises a primary armor assembly 14 in front of a secondary armor assembly 16. The layers of the armor module are designed such that the fragments exiting therefrom are within the level or protection of the hull 12, i.e., they can be defeated thereby.

The primary armor assembly 14 comprises a hard layer 22 constituting a strike face, which may be made of high-hardness steel, and is positioned so as to face the EFP 5, i.e., at the front-most position of the armor, when the armor module 10 is mounted to the hull 12. Alternatively, it may be made of ceramic pellets, or any other material configured to fragment an impinging EFP threat into residuals. An adhesive sub-layer 24, which may comprise a fiber-reinforced adhesive, is applied to the backside (i.e., non-threat-facing side) of the hard layer 22, and is used to attach a backing layer 26 thereto. The adhesive may comprise a thermoplastic and/or thermoset material, or any other appropriate material.

The backing layer 26 may be made of a woven aramid material, such as that sold under the trade name K3000 may be disposed behind the strike face 22. The ballistic impedance (which is defined as the product between a material's specific density ρ and the speed of sound through the material, and is useful for quantifying the propagation of a shockwave through a material, for example due to a ballistic impact) of the backing layer 26 may be closer to that of the hard layer 22 than any of the other layers of the primary armor assembly. This limits the damage to the hard layer 22 as the shockwave due to impact of a threat thereupon crosses between layers.

A unidirectional fiber layer 28 made of a material comprising unidirectional aramid fibers formed as part of a laminate, such as Gold Shield® made by Honeywell, is disposed behind the backing layer 26. The unidirectional fiber layer 28 is designed such that fibers thereof envelop a residual of the fragmented EFP 5 which pass therethrough, and remain enveloping it as it exits the layer. This may be accomplished, for example, by ensuring that the tensile strength of the fibers exceeds the force required to remove them from the laminate. With such a design, when fibers of the unidirectional fiber layer 28 are struck by a residual, they are removed from the laminate and remain on the residual before they undergo tensile failure. As the fibers remain enveloped around the residual, they serve to thermally insulate it as in enters the next later. The significance of this will be explained below.

The hard layer 22, backing layer 26, and unidirectional fiber layer 28 together constitute a strike layer, which functions to disrupt the EFP, e.g., by spreading its impact, and preventing secondary fragmentation thereof.

An optional primary standoff 30 may be provided behind the unidirectional fiber layer 28. The standoff gives allows space for the fragments of the disrupted EFP to disperse.

A catcher layer 31 is provided behind the unidirectional fiber layer 28 (behind the primary standoff 30 in a case where it is provided) It comprises one or more pressed polypropylene sub-layers 32. The polypropylene may be, for example, similar to that sold under the trade name Tegris™, sold by Milliken & Company. The polypropylene may be high-tenacity and it may be provided as unidirectional (UD) or plain weave of strips made of UD fibers. The catcher layer 31 constitutes an absorbing/diverting layer, which functions to absorb/divert fragments of the disrupted EFP from the previous layer.

Ideally, a single thick polypropylene sub-layer 32 is to be provided; however, due to current manufacturing limitations of high pressure pressing, several of such sub-layers may be provided in order to reach a desired thickness when combined. (It will be appreciated that if these limitations would be overcome, a single polypropylene sub-layer 32 may be provided.) When a unidirectional polypropylene is provided, the directions of adjacent layers may be parallel to one another or at an angle to one another. Although no adhesive is necessary between adjacent layers, a polypropylene resin may be provided between adjacent layers.

Alternatively, the catcher layer 31 comprises one or more high density polyethylene layers. In such a case, the thickness of the layer could be reduced without impacting the overall weight of the layer.

The design of the catcher layer 31 is based on that of the unidirectional fiber layer. For example:

- The material of the catcher layer 31 exhibits a level of ballistic protection which is at least 20% higher than that of the unidirectional fiber layer 28, i.e., a layer of the material of the catcher layer which is of the same thickness as that of the unidirectional fiber layer absorbs at least 20% more energy of one of the residuals than the unidirectional fiber layer absorbs for the same residual at the same speed, as is well known in the art. In addition, the catcher layer 31 may be made of a material which exhibits a level of ballistic protection which is at least 30% higher than that of the unidirectional fiber layer 28.
- Both the unidirectional fiber layer 28 and the catcher layer 31 may comprise pressed fibers within a laminate. The density of the pressed fibers of the catcher layer 31 may be at least four times greater than that of the unidirectional fiber layer 28; i.e., the catcher layer may comprise four times as many fibers per unit thickness than does the unidirectional fiber layer. This may be accomplished, for example, by providing different sized fibers for the two layers, and/or by providing a more compressed material for the catcher layer 31.
- The fibers of the catcher layer may exhibit a specific tensile strength (i.e., tensile strength per unit cross-sectional area of the fiber) which is at least 10% greater than that of the fibers of the unidirectional fiber layer 28, as is well known in the art.
- The catcher layer 31 may be sensitive to an elevated temperature of an impinging threat, i.e., it may provide a reduced level of ballistic protection against a projectile having an elevated temperature associated with residuals of the EFP; i.e., the level of protection of the catcher layer against residuals which are at an elevated temperature due to their recent fragmentation from an EFP is reduced compared to its level of protection against residuals at a lower temperature, as is well known in the art. The level of ballistic protection exhibited by the unidirectional fiber layer 28 is substantially unchanged, or reduced less, at this temperature compared to that exhibited at lower temperatures. Thus, the fibers of the unidirectional fiber layer 28 which envelop the residual even after it exits the unidirectional fiber layer serve to thermally insulate it, thus enabling the catcher layer 31 to provide a higher level of ballistic protection thereagainst.

The secondary armor assembly 16 comprises a secondary hard layer 18 comprising a segmented ceramic sub-layer 34, which may be similar to that sold under the trade name SMART™ by Plasan, and which is described, for example, in co-pending Israel patent applications IL149591, IL169230, IL190360, and IL182511, the contents of which are incorporated herein by reference. Ceramic pellets of the segmented ceramic sub-layer 34 may each have cylindrical, hexagonal, or any other desired cross-section, and they may be provided as capped or non-capped elements.

A secondary backing layer 36, for example made of a woven aramid material such as K3000, may be provided behind the secondary hard layer. In addition, other layers, such as a high-harness steel sub-layer 38, an additional secondary backing layer 40 made of a woven aramid material such as K3000, and a secondary unidirectional fiber layer 42 made of a unidirectional aramid material, such as Gold Shield®, may be provided.

The secondary armor assembly 16 comprises a polypropylene secondary catching layer 44, which may be similar to the polypropylene sub-layer 32 of the catcher layer 31 of the primary armor assembly 14.

Either of the catching layers 31, 44 may alternatively comprise one or more high density polyethylene layers instead of or in addition to a polypropylene layer. In such a case, the thickness of the layer could be reduced without impacting the overall weight thereof.

The hull 12 may comprise a high-hardness steel layer 46, with a spall liner 48, for example made of K3000 or UD aramid, high density polyethylene, a composite liner material, or a combination thereof, therebehind.

The armor module 10 may be mounted to the hull 12 by any appropriate means, for example with mounting rods 50. A mounting standoff 52 may be provided between the armor module 10 and the hull 12. This standoff accommodates a non-uniform hull profile, for example allowing the module 10 to be mounted to the hull 12 without being disturbed by members projecting therefrom, and further allows for fragments exiting the armor to disperse before impacting on the hull strike face. The mounting standoff 52 may be smaller or larger than the primary standoff 30.

A non-limiting example of an armor module 10 is summarized in Table 1 below, with reference numerals provided, which correspond to those used in the text:

TABLE 1

| LAYER NAME | MATERIAL | ARIAL DENSITY ($kg/m^2/mm_{thickness}$) | THICKNESS (mm) | TOTAL WEIGHT ($kg/m^2$) |
|---|---|---|---|---|
| Hard Layer 22 | HH Steel | 7.85 | 10 | 78.5 |
| Backing Layer 26 | K3000 | 1.2 | 5 | 6 |
| Unidirectional Fiber Layer 28 | Gold Shield | 1.4 | 25 | 35 |
| Primary Standoff 30 | None | N/A | 40 | 0 |
| Catcher Layer 31 | Tegris | 0.78 | 156 | 121.68 |
| Secondary Hard Layer 18 | SMART | 3.32 | 17 | 56.44 |
| Secondary Backing Layer 36 | K3000 | 1.2 | 3 | 3.6 |
| Steel Sub-Layer 38 | HH Steel | 7.85 | 3.2 | 25.12 |
| Additional Secondary Backing Layer 40 | K3000 | 1.2 | 4 | 4.8 |
| Secondary Unidirectional Fiber Layer 42 | Gold Shield | 1.4 | 10 | 14 |
| Secondary Catching Layer 44 | Tegris | 0.78 | 52 | 40.56 |
| Mounting Standoff 52 | None | N/A | 25 | 0 |
| Hull 10 | HH Steel | 7.85 | 10 | 78.5 |
| | K3000 | 1.2 | 15 | 18 |

It can be seen from Table 1 that the total weight of the armor module is 385.7 $kg/m^2$. For comparison, conventional armor modules which offer the same level of ballistic protection against an EFP threat may have a weight which is significantly higher, such as approximately 1040 $kg/m^2$ for a rolled homogeneous armor (RHA), or approximately 650 $kg/m^2$ for a conventional layered metal technology.

Those skilled in the art to which this invention pertains will readily appreciate that numerous changes, variations and modifications can be made without departing from the scope of the invention mutatis mutandis. For example, additional standoffs may be provided between other layers, for example between the secondary strike layer 18 and the secondary absorbing/diverting layer 20, etc.

The invention claimed is:

1. An armor module for protecting a surface against an explosively formed projectile (EFP) threat, said armor module being configured for mounting on said surface and comprising at least one armor assembly comprising:

a hard layer disposed facing the threat and being configured to fragment the EFP;

a unidirectional fiber layer disposed behind said hard layer; and a catcher layer behind said unidirectional fiber layer, said catcher layer being made of a material exhibiting a level of ballistic protection such that a layer of said material being of the same thickness as said unidirectional fiber layer absorbs at least 20% more energy than said unidirectional fiber layer for the same threat.

2. An armor module according to claim 1, wherein the specific weight of said catcher layer is no more than 90% of that of the unidirectional fiber layer.

3. An armor module according to claim 1, wherein the fibers in said unidirectional fiber layer constitute a portion of a laminate, the tensile strength of most of the fibers exceeding the force required to remove them from the laminate.

4. An armor module according to claim 1, wherein said unidirectional fiber layer comprises aramid fibers.

5. An armor module according to claim 1, wherein said catcher layer comprises a plurality of pressed fibers.

6. An armor module according to claim 5, wherein said fibers of the catcher layer are arranged unidirectionally.

7. An armor module according to claim 5, wherein said plurality of pressed fibers of the catcher layer are made from a material selected from the group consisting of polypropylene and high density polyethylene.

8. An armor module according to claim 5, wherein said catcher layer comprises at least two times as many fiber layers per unit thickness thereof than does the unidirectional fiber layer.

9. An armor module according to claim 5, wherein the fibers of said catcher layer are characterized by a specific tensile strength which is at least 10% greater than those of the unidirectional fiber layer.

10. An armor module according to claim 1, wherein the material of said catcher layer is more sensitive to an elevated temperature of an impinging threat than is the material of the unidirectional fiber layer.

11. An armor module according to claim 1, wherein said hard layer is provided with a backing layer facing said catcher layer, each of said hard, backing, and catcher layers being characterized by a ballistic impedance such that the ballistic impedance of said backing layer is lower than that of the hard layer and higher than that of the catcher layer.

12. An armor module according to claim 11, wherein said backing layer comprises an at least partially woven aramid material.

13. An armor module according to claim 1, wherein said hard layer comprises a material selected from the group consisting of high-hardness steel and ballistic ceramic.

14. An armor module according to claim 1, wherein said armor assembly further comprises a stand-off between said unidirectional fiber and catcher layers, said stand-off being free of material of the module.

15. An armor module according to claim 1, further comprising at least two armor assemblies, wherein one of said armor assemblies is disposed in front of another of said armor assemblies.

* * * * *